US009777472B2

(12) United States Patent
Wiker et al.

(10) Patent No.: US 9,777,472 B2
(45) Date of Patent: Oct. 3, 2017

(54) SCRIM ATTACHMENT SYSTEM

(71) Applicant: ARMSTRONG WORLD INDUSTRIES, INC., Lancaster, PA (US)

(72) Inventors: Anthony L. Wiker, Lancaster, PA (US); Peter J. Oleske, Lancaster, PA (US); Lida Lu, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 14/925,552

(22) Filed: Oct. 28, 2015

(65) Prior Publication Data

US 2017/0121964 A1 May 4, 2017

(51) Int. Cl.

| | |
|---|---|
| ***E04B 9/04*** | (2006.01) |
| ***E04B 1/86*** | (2006.01) |
| ***E04B 1/84*** | (2006.01) |
| ***E04B 1/99*** | (2006.01) |
| ***E04B 9/06*** | (2006.01) |
| *E04B 9/00* | (2006.01) |
| *E04B 1/74* | (2006.01) |

(52) U.S. Cl.

CPC ..... *E04B 1/8409* (2013.01); *E04B 1/86* (2013.01); *E04B 1/99* (2013.01); *E04B 9/067* (2013.01)

(58) Field of Classification Search

CPC . E04B 1/8409; E04B 1/86; E04B 1/99; E04B 9/067; E04B 9/001; E04B 9/045; G10K 11/168; G10K 11/162

USPC ..... 181/290, 291

See application file for complete search history.

(56) References Cited

U.S. PATENT DOCUMENTS

| | | | | |
|---|---|---|---|---|
| 2,277,259 A | | 3/1942 | Schnabel et al. | |
| 2,487,448 A | | 11/1949 | Kingerley, Jr. | |
| 2,993,802 A | | 7/1961 | Cascone | |
| 3,135,648 A | | 6/1964 | Hawkins | |
| 3,197,429 A | | 7/1965 | Baatrz | |
| 3,213,051 A | | 10/1965 | Pink | |
| 3,371,004 A | | 2/1968 | Kennedy | |
| 3,583,522 A | | 6/1971 | Rohweder et al. | |
| 3,668,166 A | | 6/1972 | Kane et al. | |
| 4,008,116 A | | 2/1977 | Sebel | |
| 4,040,213 A | * | 8/1977 | Capaul | E04B 1/8409 181/291 |
| 4,283,457 A | * | 8/1981 | Kolsky | B32B 5/06 156/148 |
| 4,585,685 A | | 4/1986 | Forry et al. | |
| 4,642,951 A | * | 2/1987 | Mortimer | B29C 51/00 181/290 |
| 5,115,616 A | * | 5/1992 | Nixon | E04B 9/001 52/144 |
| 5,134,014 A | * | 7/1992 | Zaima | B29C 51/14 264/321 |

(Continued)

FOREIGN PATENT DOCUMENTS

EP 1160387 B1 9/2005

OTHER PUBLICATIONS

Corresponding International Search Report for PCT/US2016/057806, dated Feb. 2, 2017. WO.

*Primary Examiner* — Edgardo San Martin
(74) *Attorney, Agent, or Firm* — Craig M. Sterner

(57) ABSTRACT

The present invention is directed to ceiling panels formed from a porous scrim that is coupled to an acoustical substrate using a scrim attachment system that includes an adhesive.

20 Claims, 4 Drawing Sheets

(56) References Cited

U.S. PATENT DOCUMENTS

| | | | | |
|---|---|---|---|---|
| 5,674,594 | A | 10/1997 | Sensenig | |
| 5,681,408 | A | 10/1997 | Pate et al. | |
| 5,888,626 | A | 3/1999 | Sensenig | |
| 6,443,257 | B1 | 9/2002 | Wiker et al. | |
| 6,547,868 | B1 | 4/2003 | Belmares et al. | |
| 6,613,424 | B1 * | 9/2003 | Putt | B28C 5/381 106/122 |
| 7,033,963 | B2 | 4/2006 | Felegi et al. | |
| 7,294,218 | B2 * | 11/2007 | Haque | B29C 70/086 156/148 |
| 7,757,811 | B2 * | 7/2010 | Fox | B32B 5/26 181/286 |
| 7,837,009 | B2 * | 11/2010 | Gross | B32B 27/12 181/208 |
| 7,878,301 | B2 * | 2/2011 | Gross | B32B 5/22 181/286 |
| 7,918,313 | B2 * | 4/2011 | Gross | G10K 11/162 181/284 |
| 7,947,615 | B2 | 5/2011 | Springer et al. | |
| 8,100,226 | B2 | 1/2012 | Cao et al. | |
| 8,365,862 | B2 | 2/2013 | Coates et al. | |
| 8,496,088 | B2 | 7/2013 | Kitchen et al. | |
| 8,925,677 | B2 * | 1/2015 | Dugan | E04B 1/84 181/290 |
| 2006/0014455 | A1 * | 1/2006 | Sheffer | B32B 27/12 442/59 |
| 2009/0229032 | A1 * | 9/2009 | Stepanian | B01J 13/0091 2/69 |
| 2010/0129643 | A1 | 5/2010 | Yeung | |
| 2010/0146887 | A1 | 6/2010 | Wiker et al. | |
| 2015/0225881 | A1 | 8/2015 | Paradis et al. | |

* cited by examiner

SCRIM ATTACHMENT SYSTEM

FIELD OF INVENTION

The present invention is directed to ceiling panels comprising porous scrims that are coupled to acoustical substrates by a scrim attachment system comprising an adhesive.

BACKGROUND

Ceiling panels impart architectural value, acoustical absorbency and attenuation, and/or utilitarian functions to building interiors. Typically, ceiling panels may be used in public areas that require noise control, such as in office buildings, department stores, hospitals, hotels, auditoriums, airports, restaurants, libraries, classrooms, theaters, cinemas, and some residential buildings.

Desirable acoustical absorbency and attenuation can be achieved by creating a ceiling panels that exhibits sufficient airflow through the panel. Achieving desirable airflow through the ceiling panel tends to be difficult when balanced against the need to bond individual layers of a multi-layered ceiling panel—such as one having a base substrate and a decorative scrim. Coupling the base substrate and decorative scrim can be achieved by applying an adhesive therebetween, however, the adhesive degrades the amount of airflow through the ceiling panel as well as increases flammability risks. Thus, there is a need for a ceiling panel that can not only provide adequate adhesive bonding between multiple layers, but also does not substantially degrade airflow through the ceiling panel while also not increasing risk of flammability or necessitating excessive amounts of fire-retardant.

SUMMARY

The present invention is directed to a ceiling panel comprising an acoustical substrate a porous scrim, and a dry-state adhesive. The acoustical substrate comprises substrate fibers and has a first major substrate surface and a second major substrate surface opposite the first major substrate surface, the acoustical substrate also has a first air flow resistance measured through the acoustical substrate from the first major substrate surface to the second major substrate surface. The porous scrim comprises scrim fibers and has a first major scrim surface and a second major scrim surface opposite the first major scrim surface. The dry-state adhesive has a solids content of at least 99% and adheres the first major substrate surface of the acoustical substrate to the second major scrim surface of the porous scrim, the dry-state adhesive comprising a gel-forming film-forming polymer, and the dry-state adhesive is present in an amount that ranges from 4 g/m$^2$ to 13 g/m$^2$.

In other embodiments, the present invention is directed to a method of forming a ceiling panel, the method comprising applying an aqueous mixture comprising water and a gel-forming polymer to at least one of a first major substrate surface of an acoustical substrate or to a second major scrim surface of a porous scrim in a substantially non-discrete pattern, bringing the first major substrate surface of the acoustical substrate into contact with the second major scrim surface of the porous scrim to form a laminate structure; and drying the laminate structure to adhere the acoustical substrate and the porous scrim together, wherein the gel-forming polymer is present in an amount ranging from 1 wt. % to 20 wt. % based on the total weight of the aqueous mixture and the aqueous mixture is applied to at least one of the first major substrate surface of the acoustical substrate or the second major scrim surface of the porous scrim in an amount ranging from 80 g/m$^2$ to 170 g/m$^2$.

In other embodiments, the present invention is directed to a ceiling panel comprising an acoustical substrate, a porous scrim, and an adhesive between the acoustical substrate and the porous scrim that adheres the acoustical substrate to the porous scrim, the adhesive comprising polyvinyl alcohol in an amount ranging from 4 g/m$^2$ to 13 g/m$^2$, wherein the polyvinyl alcohol is at least 85% hydrolyzed; and wherein the scrim adhered to the acoustical substrate exhibits a scrim pull force of at least 15 lbs/6 in$^2$.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls. The term "about" for the purpose of this invention means +/−5%. The language "substantially free" for the purpose of this invention means less than 5 wt. %.

Unless otherwise specified, all percentages and amounts expressed herein and elsewhere in the specification should be understood to refer to percentages by weight. The amounts given are based on the active weight of the material.

Figure 1:
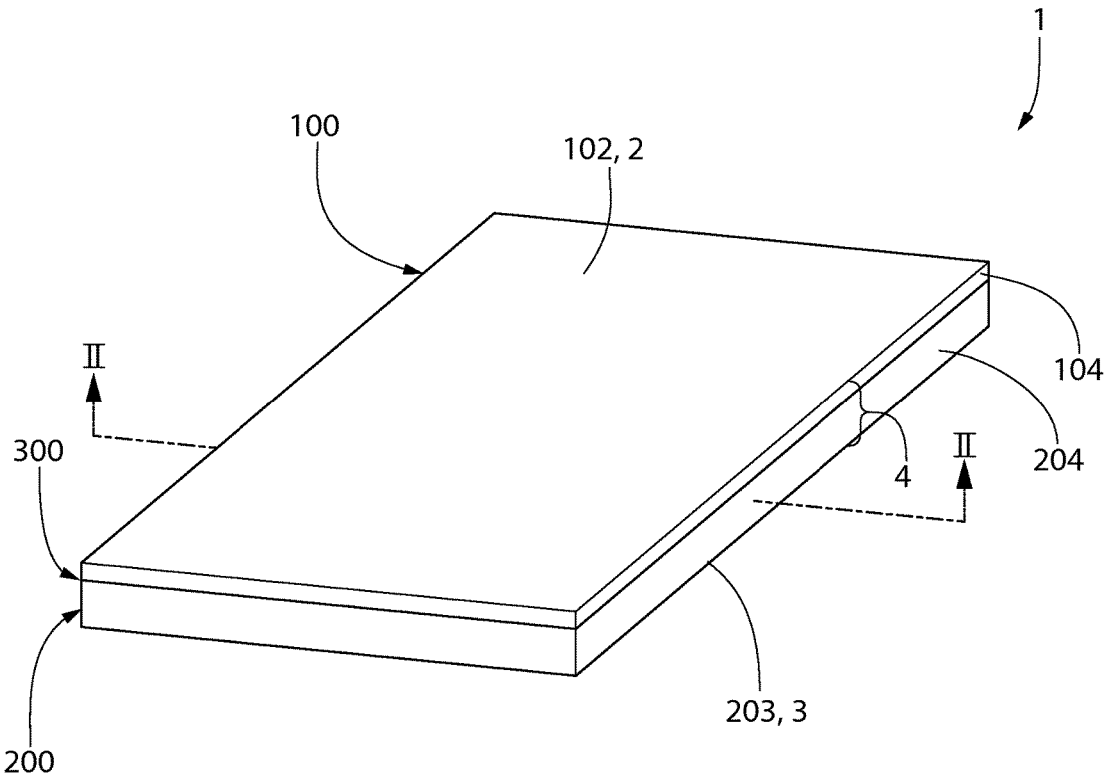
FIG. 1 is a perspective view of a ceiling panel according to the present invention.
Figure 4:
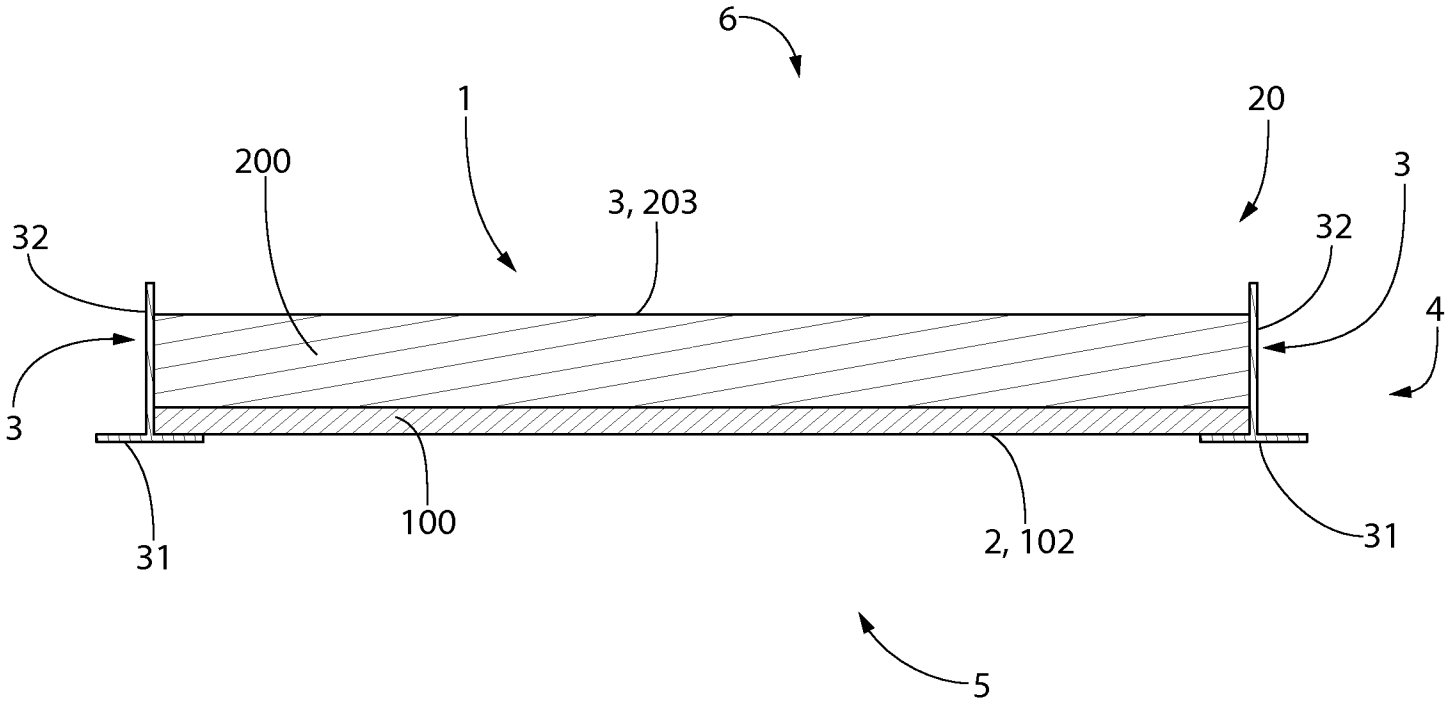
FIG. 4 is a ceiling system comprising the ceiling panel in an installed state according to present invention.

Referring to FIGS. 1 and 4, the present invention is directed to a ceiling panel 1 that is to be used in a ceiling system 20. The ceiling system 20 may comprise at least one ceiling panel 1, and at least two substantially parallel support struts 3. The ceiling system 20 may comprise a plurality of ceiling panels 1. Each of the support struts 3 may comprise an inverted T-bar having a horizontal flange 31 and a vertical web 32. The ceiling system 20 may further comprise a plurality of first struts 3 that are substantially parallel to each other and a plurality of second struts (not picture) that are substantially perpendicular to the first struts 3. In some embodiments, the plurality of second struts intersects the plurality of first struts 3 to create an intersecting ceiling support grid 7. A plenary space 6 exists above the ceiling support grid 7 and an active room environment 5 exists below the ceiling support grid 7.

Figure 3:
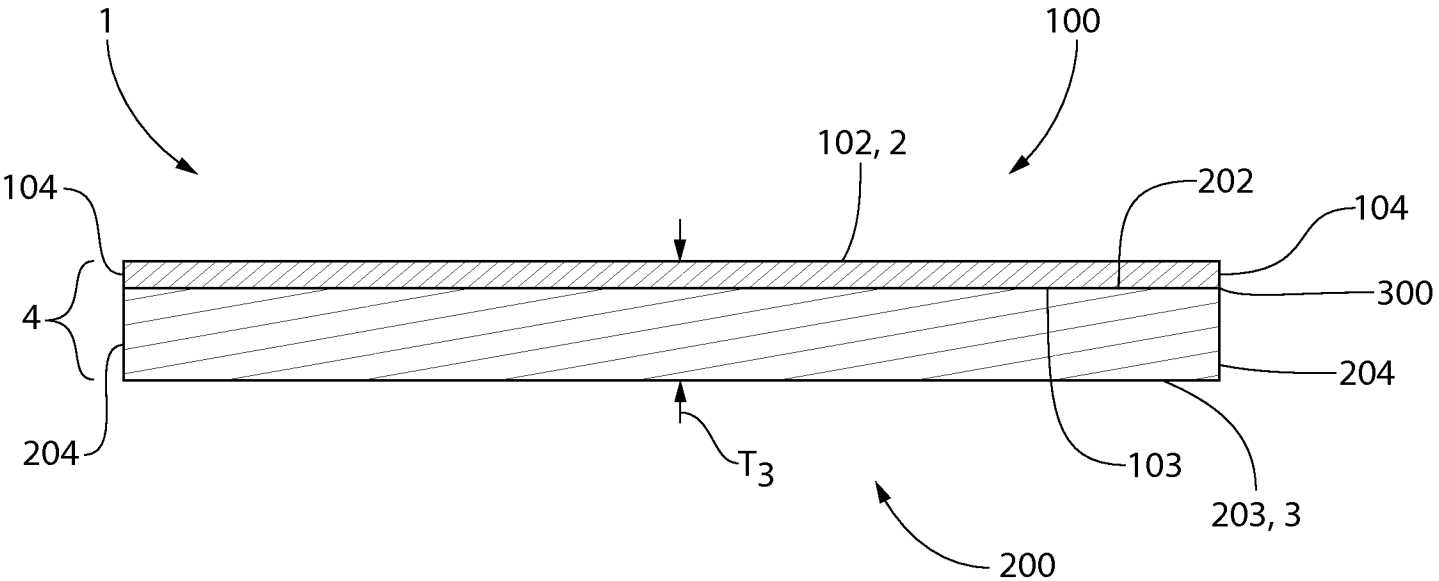
FIG. 3 is a cross-sectional view of the ceiling panel according to the present invention along line II-II of FIG. 1.

Referring to FIGS. 1 and 3, the ceiling panel 1 may comprise a first major exposed surface 2 and a second major exposed surface 3 opposite the first major exposed surface 2. The ceiling panel 1 may further comprise a side ceiling panel surface 4 that extends between the first major exposed surface 2 and the second major exposed surface 3, thereby defining a perimeter of the ceiling panel 1.

Referring to FIG. 4 in an installed state, the ceiling system 20 has the first major exposed surface 2 of the ceiling panel 1 face the active room environment 5 and the second major exposed surface 3 of the ceiling panel 1 face the plenary space 6. At least two opposite horizontal flanges 31 on the support struts 3 contact the first major exposed surface 2 of each ceiling panel 1, thereby securing the ceiling panel 1 within the ceiling support grid 7 of the ceiling system 20.

Figure 2:
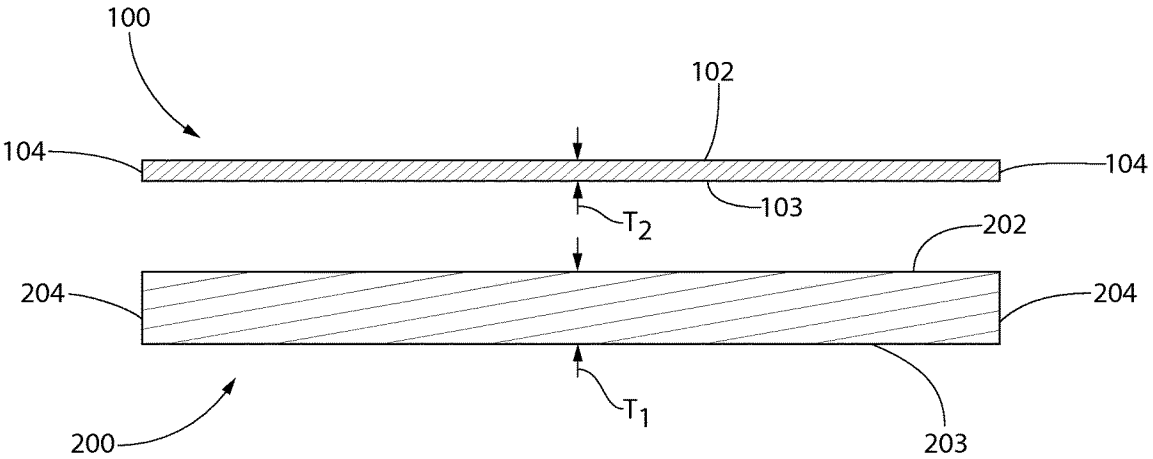
FIG. 2 is cross-sectional view of a separate acoustical substrate and porous scrim according to the present invention.

Referring now to FIGS. 1-3, the ceiling panel 1 of the present invention may comprise an acoustical substrate 200 and a porous scrim 100 coupled to the acoustical substrate 200 by an adhesive 300. As shown in FIG. 2, the acoustical substrate 200 may comprise a first major substrate surface 202 and a second major substrate surface 203 opposite the first major substrate surface 202. The porous scrim 100 may comprise a first major scrim surface 102 and a second major scrim surface 103 opposite the first major scrim surface 102. The first major exposed surface 2 of the ceiling panel 1 may comprise the first major scrim surface 102 of the porous scrim 100. The second major exposed surface 3 of the ceiling panel 1 may comprise the second major substrate surface 203 of the acoustical substrate 200.

In other embodiments, a top-coating comprising a pigment (e.g. titanium dioxide ($TiO_2$) particles) and optionally a polymeric binder may be applied to the first major scrim surface 102 of the porous scrim 100 such that at least a portion the first major exposed surface 2 of the ceiling panel 1 comprises the top coating comprising the pigment.

The ceiling panel 1 may comprise a side ceiling panel surface 4 that extends between the first and second major surfaces 2, 3 of the ceiling panel 1, thereby defining a perimeter of the ceiling panel 1. The acoustical substrate 200 may comprise a side substrate surface 204 that extends between the first major substrate surface 202 and the second major substrate surface 203, thereby defining a perimeter of the acoustical substrate 200. As shown in FIG. 1, at least a portion of the side ceiling panel surface 4 may comprise the side substrate surface 204 of the substrate 200. The porous scrim 100 may further comprise a side scrim surface 104 that extends between the first major scrim surface 102 and the second major scrim surface 103, thereby defining a perimeter of the porous scrim 100. As shown in FIG. 1, at least a portion of the side ceiling panel surface 4 may comprise the side scrim surface 104 of the scrim 100.

Referring now to FIG. 2 the acoustical substrate 200 may have a substrate thickness $T_1$, as measured from the first major substrate surface 202 to the second major substrate surface 203. In some embodiments, the substrate thickness $T_1$ ranges from about 12 mm to about 38 mm—including all sub-ranges and values there-between. The porous scrim 100 may have a scrim thickness $T_2$, as measured from the first major scrim surface 102 to the second major scrim surface 103. In some embodiments, the scrim thickness $T_2$ ranges from about 0.1 mm to about 1.0 mm—including all sub-ranges there-between. In some embodiments, the scrim thickness $T_2$ ranges from about 0.3 mm to about 0.8 mm—including all sub-ranges there-between.

The ceiling panel 1 may have a panel thickness $T_3$ as measured from the first major exposed surface 2 of the ceiling panel 1 to the second major exposed surface 3 of the ceiling panel 1. The panel thickness $T_3$ may range from about 12 mm to about 12 mm to about 38 mm. In some embodiments, the sum of the substrate thickness $T_1$ of the substrate 200 and the scrim thickness $T_2$ of the scrim 100 is about equal to the panel thickness $T_3$ of the ceiling panel 1.

The acoustical substrate 200 may be comprised of fibers and a binder. In some embodiments, the acoustical substrate 200 may further comprise filler. The acoustical substrate 200 may form a non-woven structure of the fibers. Non-limiting examples of fibers include mineral wool (also referred to as slag wool), rock wool, stone wool, fiberglass, cellulosic fibers (e.g. paper fiber, hemp fiber, jute fiber, flax fiber, or other natural fibers), polymer fibers (including polyester, polyethylene, and/or polypropylene), protein fibers (e.g., sheep wool), and combinations thereof. Depending on the specific type of material, the fibers may either be hydrophilic (e.g., cellulosic fibers) or hydrophobic (e.g. fiberglass, mineral wool, rock wool, stone wool). In some embodiments, the binder may comprise a starch, a latex, or the like. The filler may comprise powders of calcium carbonate, clay, gypsum, and expanded-perlite.

The acoustical substrate 200 may have a density ranging from about 40 $kg/m^3$ to about 250 $kg/m^3$—including all integers and sub-ranges there between. In a preferred embodiment, the acoustical substrate 200 may have a density ranging from about 40 $kg/m^3$ to about 190 $kg/m^3$—including all values and sub-ranges there-between.

The acoustical substrate 200 of the present invention may have a porosity ranging from about 60% to about 98%—including all values and sub-ranges there between. In a preferred embodiment, the acoustical substrate 200 has a porosity ranging from about 75% to 95%—including all values and sub-ranges there between. According to the present invention, porosity refers to the following:

$$\%\ \text{Porosity}=[V_{Total}-(V_{Binder}+V_{Fibers}+V_{Filler})]/V_{Total}$$

Where $V_{Total}$ refers to the total volume of the acoustical substrate 200 defined by the first major substrate surface 202, the second major substrate surface 201, and the side substrate surfaces 204. $V_{Binder}$ refers to the total volume occupied by the binder in the acoustical substrate 200. $V_{Fibers}$ refers to the total volume occupied by the fibers in the acoustical substrate 200. $V_{Filler}$ refers to the total volume occupied by the filler in the acoustical substrate 200. Thus, the % porosity represents the amount of free volume within the acoustical substrate 200.

The acoustical substrate 200 may have a first air flow resistance ($R_1$) that is measured through the acoustical substrate 200 from the first major substrate surface 202 to the second major substrate surface 203. Air flow resistance is a measured by the following formula:

$$R=(P_A-P_{ATM})/\dot{V}$$

Where R is air flow resistance (measured in ohms); $P_A$ is the applied air pressure; $P_{ATM}$ is atmospheric air pressure; and $\dot{V}$ is volumetric airflow. The first air flow resistance ($R_1$) of the acoustical substrate 200 may range from about 0.5 ohm to about 50 ohms. In a preferred embodiment, the airflow resistance of the acoustical substrate 200 may range from about 0.5 ohms to about 35 ohms.

The porous scrim 100 may be a non-woven structure comprised of fiber and a binder. The fibers may be selected from polymeric materials (e.g., polyester, polypropylene, polyethylene), fiberglass, and mineral wool. The binder may be selected latex or a thermal setting binder. The porous scrim 100 of the present invention may have a weight ranging from about 25 $g/m^2$ to about 235 $g/m^2$—including all values and sub-ranges there between. In a preferred embodiment, the porous scrim 100 of the present invention has a weight of about 25 g/m$^2$ to about 120 g/m$^2$.

The porous scrim 100 may have a third air flow resistance ($R_3$) that is measured through the porous scrim 100 from the first major scrim surface 102 to the second major scrim surface 103. The third air flow resistance ($R_3$) refers to the air flow resistance through the naked porous scrim 100 (having no top-coating applied to the first major surface 102 of the porous scrim 100). The third air flow resistance ($R_3$) of the naked porous scrim 100 may range from about 40 MKS rayls to about 200 MKS rayls. When the top-coating applied to the porous scrim 100, a fourth air flow resistance ($R_4$) may be measured through the top-coating and porous scrim 100. The fourth air flow resistance (R4) may range from about 40 MKS rayls to about 300 MKS rayls. The unit of measure MKS rayls (Pa·s/m) is measured according to the methodology set forth in ASTM C522 "Standard Test Method for Airflow Resistance of Acoustical Materials."

As shown by FIGS. 2 and 3, the ceiling panel 1 may be formed by coupling the acoustical substrate 200 to the porous scrim 100 by an adhesive 300. Specifically, the acoustical substrate 200 and the porous scrim 100 may be coupled by a scrim attachment system that comprises adhesive in a dry-state. The dry-state adhesive is substantially free of a carrier—as described further herein.

The adhesive 300 may be applied in a wet-state, wherein the wet-state adhesive comprises an aqueous mixture of gel-forming polymer and a carrier. According to the present invention, the term "gel-forming polymer" refers to polymer having an affinity for water (i.e., hydrophilic) that, when mixed with water, forms a gel that thickens (i.e., increases the viscosity) the wet-state adhesive without the need for additional viscosity modifying agents. The gel-forming polymer may be a film-forming polymer and the carrier may comprise water, organic solvent, or a combination thereof—resulting in an aqueous mixture that is either a liquid or a gel. In a preferred embodiment, the carrier includes water.

The gel-forming polymer may be film-forming and may be selected from at least one of polyvinyl alcohol (PVOH), starch-based polymers, polysaccharide polymers, cellulosic polymers, protein solution polymers, an acrylic polymer, polymaleic anhydride, or a combination of two or more thereof.

The gel-forming polymer may comprise PVOH. The PVOH may be at least 85% hydrolyzed; alternatively at least 90% hydrolyzed; alternatively at least 95% hydrolyzed; alternatively at least 99% hydrolyzed. The degree of hydrolysis refers to the degree of pendant acetyl groups that have been hydrolyzed into pendant hydroxyl groups.

Suitable starch-based polymers are in principle all starches which can be generated from natural resources. Non-limiting examples of starch-based polymers include natural or pre-gelatinized cornstarch, natural or pre-gelatinized waxy cornstarch, natural or pre-gelatinized potato starch, natural or pre-gelatinized wheat starch, natural or pre-gelatinized amylo cornstarch or natural or pre-gelatinized tapioca starch. Pre-gelatinized cornstarch and pre-gelatinized potato starch are particularly preferred.

Suitable chemically modified starches are, for example, starches degraded by acid catalysis, enzymatically or thermally, oxidized starches, starch ethers, such as, for example, allyl starch or hydroxyalkyl starches, such as 2-hydroxyethyl starches. 2-hydroxypropyl starches or 2-hydroxy-3-trimethylammoniopropyl starches, or carboxyalkyl starches, such as carboxymethyl starches, starch esters, such as, for example, monocarboxylic esters of starch, such as starch formates, starch acetates, starch acrylates, starch methacrylates or starch benzoates, starch esters of di- and polycarboxylic acids, such as starch succinates or starch maleates, starch carbamic acid esters (starch urethanes), starch dithiocarbonic acid esters (starch xanthogenates), or starch esters of inorganic acids, such as starch sulfates, starch nitrates or starch phosphates, starch ester ethers, such as, for example, 2-hydroxyalkyl-starch acetates, or full acetals of starch, as formed, for example, in the reaction of starch with aliphatic or cyclic vinyl ethers. Carboxymethyl-starches, starch succinates or starch maleates are particularly preferred.

Non-limiting examples of the polysaccharide polymers include polysaccharides of xanthan gum, tamarind seed, carrageenan, tragacanth gum, locust bean, gum arabic, guar gum, pectin, agar, mannan, and a combination thereof. Non-limiting examples of protein solution polymers may include casein, soy protein, wheat protein, whey protein, gelatin, albumin, and combinations thereof. Non-limiting examples of cellulosic polymers include carboxymethyl cellulose, carboxyethyl cellulose, hydroxypropyl cellulose, and combinations thereof. Non-limiting examples of acrylic polymer include polyacrylate, polymethacrylate, polymethylmethacrylate, polyacrylamide, and a combination thereof.

The wet-state adhesive may comprise about 80 wt. % to about 99 wt. % of the carrier, resulting in a solids content ranging from about 1 wt. % to about 20 wt. % based on the total weight of the wet-state adhesive. In some embodiments, the wet-state adhesive may comprise the gel-forming polymer in an amount ranging from about 1 wt. % to about 20 wt. % based on the total weight of the wet adhesive—including all values and sub-ranges there between. In a preferred embodiment, the wet-state adhesive may comprise the gel-forming polymer in an amount ranging from about 3 wt. % to about 12 wt. % based on the total weight of the wet state adhesive—including all values and sub-ranges there-between.

The wet-state adhesive may have a viscosity ranging from about 100 cP to about 6,000 cP—including all sub-ranges and values there-between. In a preferred embodiment, the wet-state adhesive may have a viscosity ranging from about 100 cP to about 2,000 cP—including all sub-ranges and values there-between; alternatively from about 150 cP to about 900 cP. The viscosities according to the present invention are measured by Brookfield Viscometer, #2 spindle @ 10 RPM at room temperature (about 22° C.). The wet-state adhesive may further comprise viscosity modifier such as hydrous magnesium aluminum-silicate.

The wet-state adhesive may be applied to at least one of the first major substrate surface 202 of the acoustical substrate 200 and/or the second major scrim surface 103 of the porous scrim 100 by spray coating, roll coating, dip coating, and a combination thereof. In a preferred embodiment, the wet-state adhesive may be applied solely to the first major substrate surface 202 of the acoustical substrate 200 by spray coating, roll coating, dip coating, and a combination thereof.

The wet-state adhesive may be applied to the first major surface 202 of the acoustical substrate such that the gel-forming polymer penetrates into the substrate 200 at a depth that is less than about 10% of the substrate thickness $T_1$ as measured from the first major surface 202 toward the second major surface 203 of the substrate 200. In some embodiments, the gel-forming polymer penetrates into the substrate 200 at a depth less than 5% of the substrate thickness $T_1$ as measured from the first major surface 202 toward the second major surface 203 of the substrate 200.

The wet-state adhesive may be applied to at least one of the first major substrate surface 202 of the acoustical substrate 200 or the second major scrim surface 103 of the scrim 100 in an amount ranging from about 30 g/m$^2$ to about 269 g/m$^2$—including all values and sub-ranges there-between. In a preferred embodiment, the wet-state adhesive may be applied in an amount ranging from about 30 g/m$^2$ to about 215 g/m$^2$—including all values and sub-ranges there-between.

Once applied, the first major substrate surface 202 of the acoustical substrate 200 and the second major scrim surface 103 are joined together, thereby forming a laminate structure. Specifically, the first major substrate surface 202 of the acoustical substrate 200 is brought in contact with and the second major scrim surface 103 of the scrim 100, wherein the wet-state adhesive positioned there between to form a laminate structure. The laminate structure is dried in a drying step. The laminate structure may be dried with a heating source for a period of drying time ranging from about 60 seconds to about 600 seconds—including all values there between. During the drying step, the heating source may be operated at a drying temperature ranging from about 145° C. to about 210° C. Non-limiting examples of the heating source include overhead heating lamps or an oven (such as a convection oven).

During the drying step, the carrier is driven from the wet-state adhesive yielding the dry-state adhesive 300, which couples the acoustical substrate 200 to the porous scrim 100, thereby creating the ceiling panel 1 of the present invention. The dry-state adhesive is in a dry, solid state, having a maximum water content of about 5 wt. % based on the total weight of the dry-state adhesive and comprising the gel-forming polymer also in a solid-state, preferably as a film. The dry-state adhesive may comprise less than about 5 wt. % of water; alternatively less than 3 wt. % of water. Although the dry-state adhesive may comprise minor amounts of water, the term "solid-state" refers to a composition that does not flow at room temperature. Applying the wet-state adhesive to according to the present invention ensures that the resulting adhesive 300 (i.e. dry-state adhesive) is located between the first major substrate surface 202 and the second major scrim surface 103, thereby bonding together these layers together with sufficient mechanical integrity to form the ceiling panel 1 of the present invention.

During the drying step, the carrier is evaporated from the wet-state adhesive thereby yielding the dry-state adhesive 300 that permanently couples the porous scrim 100 to the acoustical substrate 200, thereby forming the ceiling panel 1. During the drying step, as the carrier is evaporated from the continuous (non-discrete) pattern of wet-state adhesive, the gel-forming polymer remains between the acoustical substrate 200 and the porous scrim 100 leaving a discrete (discontinuous) pattern of dry, film-forming polymer. According to some embodiments, the adhesive 300 of the present invention is substantially free of carrier and has a solids content of about 100%. The dry-state adhesive 300 may be solid at room temperature and therefore incapable of flow.

Maintaining desirable airflow through the ceiling panel 100 (as measured from the first major exposed surface 2 to the second major exposed surface 3 of the ceiling panel 100) may require that the dry-state adhesive 300 be present between the acoustical substrate 200 and the porous scrim 100 in a discrete (discontinuous) pattern. The discrete pattern provides gaps in the dry-state adhesive 300 that allows a sufficient amount of air to flow through the ceiling panel 2 such that sound may still adequately transmit through the ceiling panel. Previously, ensuring that the dry-state adhesive 300 be present in a discrete pattern required that the wet-state adhesive be applied in a discontinuous (discrete) manner. Requiring discontinuous application of wet-state adhesive increases difficulty in forming the ceiling panel 100, thereby increasing time and cost of manufacture.

The ceiling panel 1 of the present invention may comprise a second airflow resistance ($R_2$) as measured from the first major exposed surface 2 to the second major exposed surface 3. In some embodiments, the second airflow resistance ($R_2$) is about 90% to about 140% of the first airflow resistance ($R_1$)—including all values and sub-ranges there-between. In other embodiments, the second airflow resistance ($R_2$) is about 105% to about 125% of the first airflow resistance ($R_1$).

According to the present invention, applying the wet-state adhesive continuously so to create a substantially non-discrete pattern in an amount ranging from about 54 g/m$^2$ to about 269 g/m$^2$, wherein the wet-state adhesive comprises an aqueous mixture of water and gel-forming polymer, the gel-forming polymer being present in an amount ranging from about 1 wt. % to about 20 wt. % based on the total weight of the wet-state adhesive (including all value and sub-ranges there-between) results in a discrete pattern of dry-state adhesive after the carrier has been driven off during the drying step. Thus, according to the present invention a discrete pattern of dry-state adhesive 300 may be formed in the ceiling panel 1 that is sufficient to couple the porous scrim 100 to the acoustical substrate 200 without necessitating the application of a discrete (discontinuous) pattern of wet-state adhesive. However, the discrete pattern of dry-state adhesive (i.e. gel-forming polymer and substantially free of carrier) may also be formed by discrete (discontinuous) application of the gel-forming polymer to at least one of the first major substrate surface 202 of the acoustical substrate 200 and/or the second major scrim surface 103 of the porous scrim 100.

Applying the wet-state adhesive, which has a solids content ranging from about 1 wt. % to about 20 wt. %, at an application rate ranging from about 54 g/m$^2$ to about 269 g/m$^2$, after the drying step, results in a discontinuous pattern of dry-state adhesive 300 between the acoustical substrate 200 and the porous scrim 100 in an amount ranging from about 4.0 g/m$^2$ to about 13.0 g/m$^2$—including all values and sub-ranges there between. The dry-state adhesive 300 may be present between the acoustical substrate 200 and the porous scrim 100 in an amount ranging from about 4.0 g/m$^2$ to about 10.0 g/m$^2$—including all values and sub-ranges there between. In a preferred embodiment, the dry-state adhesive 300 is present in a discontinuous pattern between the acoustical substrate 200 and the porous scrim 100 in an amount ranging from about 7.0 to about 8.0 g/m$^2$.

The adhesive system of the present invention, which includes the continuous application of the wet-state adhesive and the formation of a discrete pattern of dry-state adhesive not only facilitates manufacture, but also allows for less polymer to be present in the dry-state adhesive to provide a pull-strength that is sufficiently strong to couple the porous scrim 100 to the acoustical substrate 200. Specifically, the scrim attachment system of the present invention may yield a pull strength between the porous scrim 100 on the acoustical substrate 200 that ranges from about 104 lbs/6 in$^2$ to 30 lbs/6 in$^2$—including all sub-ranges and values there-between.

Reducing the overall amount of polymer required for the dry-state adhesive 300 to couple the acoustical substrate 200 to the porous scrim 100 may not only enhance the amount of airflow through the ceiling panel 1, but may also enhance fire retardancy (also referred to as flame retardancy) of the resulting ceiling panel 1. Polymer in the adhesive can increase flammability of the ceiling panel—causing or accelerating ignition and burning of a ceiling panel during a fire. Previously, flammability was reduced by adding flame suppressing additives (also referred to as "fire-retardants") such as aluminum trihydrate, calcium borate, intumescent (char formers) such as diammonium phosphate and urea-phosphate, antimony trioxide, ammonium phosphates, sodium pentaborates, ammonium sulfates, boric acids and mixtures thereof. However, according to the present invention, less polymer is needed for the dry-state adhesive to sufficiently couple the acoustical substrate 200 to the porous scrim 100. Therefore, the amount of flame retardants may be reduced—and in some embodiments, eliminated altogether—while still maintaining a desired Class A fire rating.

According to the present invention, the wet-state adhesive and the dry-state adhesive may be free of flame retardant (i.e. 0 wt. % of flame retardant based on the total weight of the wet-state and/or dry-state adhesive) and the ceiling panel 1 of the present invention may have Class A fire rating. According to other embodiments of the present invention, the ceiling panel 1 may be free of flame retardant and the ceiling panel 1 of the present invention may have Class A fire rating.

The ceiling panel 1 of the present invention may comprise a Class A (I) fire rating as measured by ASTM test method E-84, commonly known as the tunnel test for measuring flame-spread of building materials. The tunnel test measures how far and how fast flames spread across the surface of the test sample. In this test, a sample of the material is installed as ceiling in a test chamber, and exposed to a gas flame at one end. The resulting flame spread rating ("FSR") is expressed as a number on a continuous scale where inorganic reinforced cement board is 0 and red oak is 100. The scale is divided into three classes. The most commonly used flame-spread classifications are: Class A (or "I") having a FSR ranging from 0 to 25 (which represents the best performance); Class B (or "II") having a FSR ranging from 26-75; and Class "III") having a FSR ranging from 76-200 (which represents the worst performance).

The following examples were prepared in accordance with the present invention. The present invention is not limited to the examples described herein.

EXAMPLES

Experiment 1

The following experiment measures the change in airflow resistance in the acoustical substrate due to the application of wet-state adhesive//the formation of the dry-state adhesive as the change in airflow resistance in the acoustical substrate due to the addition of the porous scrim. Three examples were prepared, each example includes a substrate having an initial airflow resistance ("Initial Ω") as measured from a first major substrate surface to a second major substrate surface of the substrate. The wet-state adhesives of these examples are an aqueous mixture of water and 99+% hydrolyzed PVOH polymer. The wet-state adhesives were prepared by dispersing the PVOH polymer (i.e., gel-forming polymer) in water (i.e. carrier) and heating the mixture to a temperature of 90° C. to render a 3.06 wt. % concentration of PVOH based on the total weight of the wet-state adhesive. The wet-state adhesive is free of flame retardant.

The wet-state adhesive was applied to each of the first major surfaces of the substrates in Examples 1 and 3 in a specific amount ("wet-state adhesive g/m$^2$") resulting in an amount of gel-forming polymer on each substrate of Examples 1 and 3 ("dry-state adhesive g/m$^2$"). The wet-state adhesive was applied to form a non-discrete pattern (continuous) on the first major surface of each substrate of Examples 1 and 3. No wet-state adhesive was applied to the substrate of Example 2. Next, for each of Examples 2 and 3, a porous scrim having a first and a second major surface was brought in contact with the substrate such that the second major surface of the scrim faced the first major surface of the substrate to form a laminate structure. The adhesive covered substrate of Example 1 and the laminate structure of Example 3 were then dried in a convection oven at a temperature of 350° F. for a period of 4 minutes driving off the water rendering the adhesive in a solid, dry-state, which is free of flame-retardant.

The final airflow resistance (Ω') of each example was then measured. The final airflow resistance (Ω') of Examples 2 and 3 were measured from the first major surface of the scrim through the panel to the second major surface of the substrate. Specifically, the airflow resistance of Example 3 was also measured through the adhesive between the substrate and scrim, through the substrate to the second major surface of the substrate. The final airflow resistance (Ω') of Example 1 was measured from atop the dry-state adhesive through the substrate to the second major surface of the substrate. Furthermore, the pull strength of scrim adhered to the substrate was measured for Example 3 ("Pull Strength lb/6 in$^2$). No pull strength was measured for Examples 1 and 2 as no scrim was attached in Example 1 and no adhesive was applied in Example 2. The results are provided in Table 1.

TABLE 1

| Ex. | Initial Ω | Wet-State Adhesive g/m$^2$ | Dry-State Adhesive g/m$^2$ | Scrim Applied | Final Ω' | Δ in Ω' | Pull Force lb/6 in$^2$ |
|---|---|---|---|---|---|---|---|
| 1 | 1.4 | 151.8 | 4.6 | No | 1.3 | −7% | N/A |
| 2 | 1.4 | 0.0 | 0.0 | Yes | 1.5 | +7% | N/A |
| 3 | 1.4 | 143.1 | 4.3 | Yes | 1.7 | 21% | 18.9 |

As demonstrated by Table 1, the ceiling panel of the present invention (i.e., ceiling panel of Example 3) exhibits a minor increase in airflow resistance (+21%) compared to the airflow resistance of the substrate alone while still exhibit sufficient pull strength. The minor increase in airflow resistance, however, will not have a substantial impact acoustical performance of the ceiling panel. Furthermore, looking to both Examples 2 and 3, the increase in airflow resistance can be attributed in-part to the presence of the scrim. Specifically, comparing the ceiling panel of Example 3 to the adhesive free structure of Example 2, the ceiling panel of the present invention (i.e. ceiling panel of Example 3) demonstrates only a 13% increase in airflow resistance due to the presence of the adhesive according to the following calculation:

$$\text{Increase in } \Omega': [1.7-1.5]/1.5=13.3\%$$

Additionally, as demonstrated by Example 1, the adhesive system of the present invention may in fact decrease airflow resistance of the substrate. After application of the wet-state adhesive and drying the substrate, the resulting fibers present in the substrate may contract increasing pore size, thereby allowing better air flow through the substrate. Thus, ceiling panels that use the adhesive system of the present invention exhibit desirable airflow properties while also maintaining proper adhesive strength (represented by Pull Force).

Experiment 2

The following experiment measures the pull strength between the acoustical substrate and the porous scrim using the scrim attachment system of the present invention versus other adhesive systems. The experiment uses the following wet-state adhesive//dry-state adhesive systems:

i. System A: aqueous mixture of water and 6 wt. % of PVOH (99.65% hydrolyzed); the aqueous mixture having a viscosity of 125 cP (as measured by Brookfield Viscometer, #2 spindle @ 10 RPM at room temperature—about 22° C.).

ii. System C: aqueous mixture of water and 35 wt. % of vinyl acrylate polymer and 25 wt. % of mineral filler and ammonium phosphate (flame retardant).

The wet-state adhesive was applied to each of the first major surfaces of the in a specific amount ("Wet-State Adhesive g/m$^2$") resulting in an amount of film-forming gel-forming polymer on each substrate of Examples 4-6 ("Dry-State Adhesive g/m$^2$"). The wet-state adhesive of Example 4 was applied to form a non-discrete pattern (continuous) on the first major surface of the substrate. Next, a porous scrim having a first and a second major surface were brought in contact with each of the substrates of Examples 4-6 such that the second major surface of the scrim faced the first major surface of the substrate thereby forming a laminate structure. Each laminate structure was then dried in a convection oven at a temperature of 300° F. for a period of 5 minutes, thereby evaporating the carrier (i.e. water) from the wet-state adhesive to create the dry-state adhesive that is solid (i.e., does not flow) in a discrete pattern. The pull strength of the scrim of each ceiling panel was then measured and provided in Table 2

TABLE 2

| Ex. | System | Wet-State Adhesive g/m$^2$ | Dry-State Adhesive g/m$^2$ | Polymer g/m$^2$ | Pull Force lb/6 in$^2$ |
|---|---|---|---|---|---|
| 4 | A | 129 | 7.7 | 7.7 | 24.2 |
| 5 | C | 65 | 38.7 | 22.6 | 14 |
| 6 | C | 97 | 58.1 | 33.9 | 30 |

The "Dry-State Adhesive g/m$^2$" generally represents the amount of solids present between the porous scrim and the acoustical substrate—including any filler or viscosity modifier. Minor amounts of water may remain in the dry-state adhesive that was not driven off during the drying stage. The "Polymer g/m$^2$" represents the amount of polymer present that couples together the porous scrim and the acoustical substrate. Comparative Examples 5 and 6 have a solids content greater than the polymer content because of the need of additional viscosity modifiers and/or flame retardants not required by the adhesive system of Example 4.

As demonstrated by Table 2, using the scrim attachment system of the present invention (i.e. Example 4) results in a ceiling panel having a porous scrim coupled to an acoustical substrate that not only exhibits sufficient pull strength compared to other wet-state//dry-state adhesive systems that require greater amounts of polymer, but in some cases performs even better than higher polymer content wet-state adhesive//dry-state adhesive systems (i.e. Example 5).

Experiment 3

The following experiment measures the flame spread value of the ceiling panel according to the present invention. The ceiling panel of Example 3 was submitted for a 30-30 flame-spread screening test using an E-84 Steiner Tunnel. Multiple strips of the ceiling panel of Example 3—each having a length of 39 inches—were tested and the average maximum flame-length recorded was about 7.4 inches, translating into a flame-spread rating of 13 and falling within Class A rating. Thus, not only does the ceiling panel of the present invention provide adequate airflow and pull strength, but also exhibits superior fire-retardancy—even without the addition of fire-retardant.

As those skilled in the art will appreciate, numerous changes and modifications may be made to the embodiments described herein, without departing from the spirit of the invention. It is intended that all such variations fall within the scope of the invention.

The invention claimed is:

1. A ceiling panel comprising:

an acoustical substrate comprising substrate fibers and having a first major substrate surface and a second major substrate surface opposite the first major substrate surface, the acoustical substrate having a first air flow resistance measured through the acoustical substrate from the first major substrate surface to the second major substrate surface;

a porous scrim comprising scrim fibers and having a first major scrim surface and a second major scrim surface opposite the first major scrim surface;

a dry-state adhesive that is solid at room temperature and comprises less than 5 wt. % of water, the dry-state adhesive adhering the first major substrate surface of the acoustical substrate to the second major scrim surface of the porous scrim, the dry-state adhesive comprising a gel-forming film-forming polymer; and wherein the dry-state adhesive is present in an amount that ranges from 4 g/m$^2$ to 13 g/m$^2$.

2. The ceiling panel according to claim 1, wherein the acoustical substrate has a density ranging from 40 kg/m$^3$ to 190 kg/m$^3$.

3. The ceiling panel according to claim 1, wherein the acoustical substrate has a porosity ranging from 75% to 95%.

4. The ceiling panel according to claim 1, wherein the gel-forming film-forming polymer comprises at least one of polyvinyl alcohol, starch polymer, polysaccharide polymer, cellulosic polymers, protein solution polymer, an acrylic polymer, polymelaic anhydride, or a combination of two or more thereof.

5. The ceiling panel according to claim 1, wherein the gel-forming polymer comprises polyvinyl alcohol that is at least 85% hydrolyzed.

6. The ceiling panel according to claim 1, wherein the acoustical substrate comprises a base material selected from the group consisting of mineral wool, fiberglass, cellulosic fibers, polymer fibers, protein fibers, and combinations thereof.

7. The ceiling panel according to claim 1, wherein the porous scrim comprises a non-woven structure of fiberglass.

8. The ceiling panel according to claim 1, wherein the ceiling panel has a second air flow resistance that ranges from 90% to 140% of the first air flow rate as measured through the ceiling panel from the first major scrim surface to the second major substrate surface.

9. The ceiling panel according to claim 1, wherein the dry-state adhesive is present in an amount ranging from 4 $g/m^2$ to 8 $g/m^2$.

10. The ceiling panel according to claim 1, the dry-state adhesive being free of fire retardant and having a Class A fire rating as measured by ASTM Test Method E-84.

11. A ceiling panel comprising:

an acoustical substrate;

a porous scrim; and an adhesive between the acoustical substrate and the porous scrim that adheres the acoustical substrate to the porous scrim, the adhesive comprising polyvinyl alcohol in an amount ranging from 4 $g/m^2$ to 13 $g/m^2$, wherein the polyvinyl alcohol is at least 85% hydrolyzed; and wherein the scrim adhered to the acoustical substrate exhibits a scrim pull force of at least 15 $lbs/6in^2$.

12. The ceiling panel according to claim 11, the adhesive being free of fire retardant and having a Class A fire rating as measured by ASTM Test Method E-84.

13. The ceiling panel according to claim 11, wherein porous scrim comprises non-woven fiberglass.

14. The ceiling panel according to claim 11, wherein the acoustic substrate comprises fibers selected from the group consisting of mineral wool, fiberglass, cellulosic fibers, polymer fibers, protein fibers, and combinations thereof.

15. The ceiling panel according to claim 11, wherein the acoustical substrate has a porosity ranging from 75% to 95%.

16. A ceiling panel comprising:

an acoustical substrate comprising fibers and having a first major surface opposite a second major surface a porous scrim comprising adhered to the first major surface by a dry-state adhesive forming a discontinuous coating between the first major surface and the porous scrim; and wherein the dry-state adhesive is present in an amount up to about 13 $g/m^2$ and comprises a gel-forming polymer selected from the group consisting of polyvinyl alcohol (PVOH), starch polymer, polysaccharide polymer, cellulosic polymer, protein solution polymer, acrylic polymer, polymaleic anhydride, or a combination of two or more thereof.

17. The ceiling panel according to claim 16, wherein the acoustical substrate has a porosity ranging from 75% to 95%.

18. The ceiling panel according to claim 17, wherein the porous scrim comprises a non-woven fiberglass.

19. The ceiling panel according to claim 18, wherein the fibers are selected from the group consisting of mineral wool, fiberglass, cellulosic fibers, polymer fibers, protein fibers, and combinations thereof.

20. The ceiling panel according to claim 18, wherein the dry-state adhesive is present in an amount up to about 8 $g/m^2$.

* * * * *